United States Patent [19]

Rasekhi et al.

[11] 4,022,157

[45] May 10, 1977

[54] MAGNETIC BRUSH DEVELOPER EQUIPPED WITH SELF-METERING CONTROLS

[75] Inventors: Houshang Rasekhi, Warrensville Heights; Philip Owen Shemkunas, Mentor, both of Ohio

[73] Assignee: Addressograph Multigraph Corporation, Cleveland, Ohio

[22] Filed: Aug. 4, 1975

[21] Appl. No.: 601,287

[52] U.S. Cl. ..... 118/658; 355/3 DD; 427/18

[51] Int. Cl.[2] ..... B05B 5/00; G03G 15/09

[58] Field of Search ..... 118/637, 9; 427/18; 355/3 DD

[56] References Cited

UNITED STATES PATENTS

| | | | |
|---|---|---|---|
| 3,152,012 | 10/1964 | Schaffert | 355/3 DD |
| 3,608,522 | 9/1971 | Davidson | 118/637 |
| 3,639,050 | 2/1972 | Staller | 355/3 DD |
| 3,697,050 | 10/1972 | Stanley | 118/637 X |
| 3,849,161 | 11/1974 | Klaenhammer | 118/637 X |
| 3,855,969 | 12/1974 | Andrako | 118/637 |
| 3,927,640 | 12/1975 | Smith | 116/637 |

FOREIGN PATENTS OR APPLICATIONS

| | | | |
|---|---|---|---|
| 47-20758 | 6/1972 | Japan | 355/3 DD |

OTHER PUBLICATIONS

IBM Technical Disclosure Bulletin, "Magnetic Brush Unit With Magnetic Conveyor," By Preeman et al., vol. 15, No. 4, Sept. 1972.

*Primary Examiner*—James Kee Chi
*Attorney, Agent, or Firm*—Sol L. Goldstein

[57] ABSTRACT

The magnetic brush arrangement provides for the formation of a brush-like mass made up of a pulverulent mix of carrier particles and toner particles supplied in measured amounts. Measured amounts of developer particles are picked up in the flutes provided on the surface of a rotating drum which is partially immersed in the granular mass. The flutes are axially parallel to the axis of rotation of the drum and it is the volume capacity of the flutes that determines the quantity of developer mix picked up and conveyed to a developing station. At the developing station there is provided a series of cylinders having disposed within magnetic flux generating means so as to attract the granular mass of particles from the flutes and pass it along the series of cylinders in the form of a moving carpet of developer mix. The attracted granular mass, which is held to the surface of these cylinders by virtue of the flux generating means, forms an upstanding brush whose size is controlled by the quantity of developer mix initially delivered. The brush formation occurs in the path of the copy material to be developed and at the end of the developing station unused powder is returned to the supply.

7 Claims, 2 Drawing Figures

10
12
14
16
18
20
21
22
24
26
28
30
32
34
36
38
40
42
44
46
48
50
52
54
56
58
59
60
62
63
64
66
68
70
72
74
N
S

MAGNETIC BRUSH DEVELOPER EQUIPPED WITH SELF-METERING CONTROLS

GENERAL BACKGROUND

This invention deals generally with magnetic brush developing structures and in particular with a developer in which measured quantities of the mix are brought to the developing station.

The technology dealing with design and construction of magnetic brushes is well known. The use of magnetic flux generating means positioned inside rotating cylinders for the purpose of attracting a quantity of granular mass to its surface to form an upstanding brush and applying toner to the image-bearing medium is a well known developing technique in this art.

It is well understood in this technology that the magnetically attractable developer mixes, which are made up of magnetically attractable materials plus an electroscopic resin particle, suffer fatigue due to the degradation of the developer mix. Fatigue is caused by the severe forces present in the conventional developer brush systems. One of the major areas in the magnetic brush construction concerns the use of metering blades and doctoring devices to control the height of the brush at the developing site. This is a critical and important aspect of the known construction since the success of proper magnetic brush development depends on the quality of the brush. The size of the brush, which is brought against the surface of the area to be developed, must be controlled within strict limits to produce quality reproductions. If the brush is too small, development will be inadequate and give poor or low density images. If the brush is too large or too thick, it will disrupt the paper from its assigned path and dislodge any toner that is applied. Hence, it is critical to control the size of the brush The prior art systems, as stated earlier, used mechanical means in the path of the developer mix to doctor the height of the mass to a predetermined level, and otherwise compress it in order to achieve the desired height. The use of such doctoring blades and compression devices in the presence of magnetic fields, while they control the height of the brush formation, were detrimental in terms of compacting the resinous materials interfering with its free-flowing quality and ultimately to press the toner particles onto the carrier so as to defeat the triboelectric charges necessary to be generated by the rubbing action between the two dissimilar materials comprising the mix.

These disadvantages have been obviated in the present invention by eliminating the need for doctoring or shearing or compressing the developer mix in order to form a brush of a predetermined height or thickness or otherwise scrape or remove the toner under conditions where it is being held by a high magnetic flux field. The need for any such metering devices has been eliminated by providing a measured mass and controlled amount of developer mix from the supply when it is first delivered to the brush forming developing cylinders. The controlled mass forms into an upstanding brush-like formation under the influence of the magnetic flux generating means within the developer cylinders. It will be appreciated that by limiting and controlling the mass of developer mix delivered to the developer cylinders limits the size of the brush formation that occurs at the developer station under the influence of the high magnetic flux field.

SUMMARY OF THE INVENTION

The magnetic brush developer construction of this invention provides for a series of developer cylinders which are aligned in axial parallel relationship with one another and lying in a horizontal plane, each having magnetic flux generating means within the cylinders to produce the magnetic flux necessary to cause the granular mass delivered to form into an upstanding brush. It is desirable to have a plurality of cylinders. In the instant construction three such cylinders are used in which the polarities of the magnetic flux generating means within the rolls are disposed so as to distribute the developer mix uniformly amongst the three cylinders. This arrangement provides a brush-like carpet formation of pulverulent mass made up of carrier and toner particles over which the latent image-bearing copy must pass and be brushed by the developer mix to develop a material image thereon.

Pairs of in-feed and out-feed rollers are provided to bring the copy sheet into rubbing contact with the moving developer brush and to direct it out from the developer.

The brush-like arrangement together with the in-feed and out-feed rollers are received in a supply enclosure which contains a supply of developer mix deposited in the bottom portion.

The point of novelty of the present invention resides in the means for bringing the developer mix deposited in the bottom of the developer enclosure to the series of developer cylinders adjacent the paper feed path. In one embodiment of this invention, the feed means comprises a cylindrical or drum-like structure having a series of flutes extending over its surface in parallel alignment with the axis of rotation. Each of the flutes picks up annd carries a measured mass of developer mix which is then brought to the developer station. The mass of granular material that is delivered to the developer brush is controlled by the volume size of the flutes.

In another embodiment, the novel feature of controlling the mass of developer particles is achieved by covering the drum surface with a blanket capable of generating a magnetic flux field which can pick up a controlled mass of particles as a function of the strength of the flux field.

Within the reservoir portion of the housing adjacent the developer mix metering drum is a device for mixing the powder mass in order to avoid any cavitation that may occur in the large mass of developer material in the vicinity of the rotating drum.

Any unused developer mix coming off of the developer cylinders is collected by a suitable scraper and baffle-distributer system which returns the unused mix to the mixing section.

It is a general object of this invention to provide an improved magnetic brush which minimizes the shearing, compression, and impact forces which tend to have a deliterious effect on the toner and thereby prolong its functional life.

It is another object of this invention to provide an improved magnetic brush developer system in which measured amounts of developer mix are fed to the developer brush obviating the need for any doctoring or compaction devices to control the height or size of developer mix formed on the brush to give optimum contact with the latent image on the copy sheet and thereby prolong the useful like of the developer mix.

It is a specific object of this invention to provide an improved magnetic brush developer construction in which measured amounts of developer mix are fed from a supply to the developer brush forming zone by means of a feeder unit which is equipped with a series of carriers on its surface of picking up and holding measured amounts of toner necessary to form a developer brush of the appropriate dimensions.

DETAILED DESCRIPTION

Figures 1, 2:
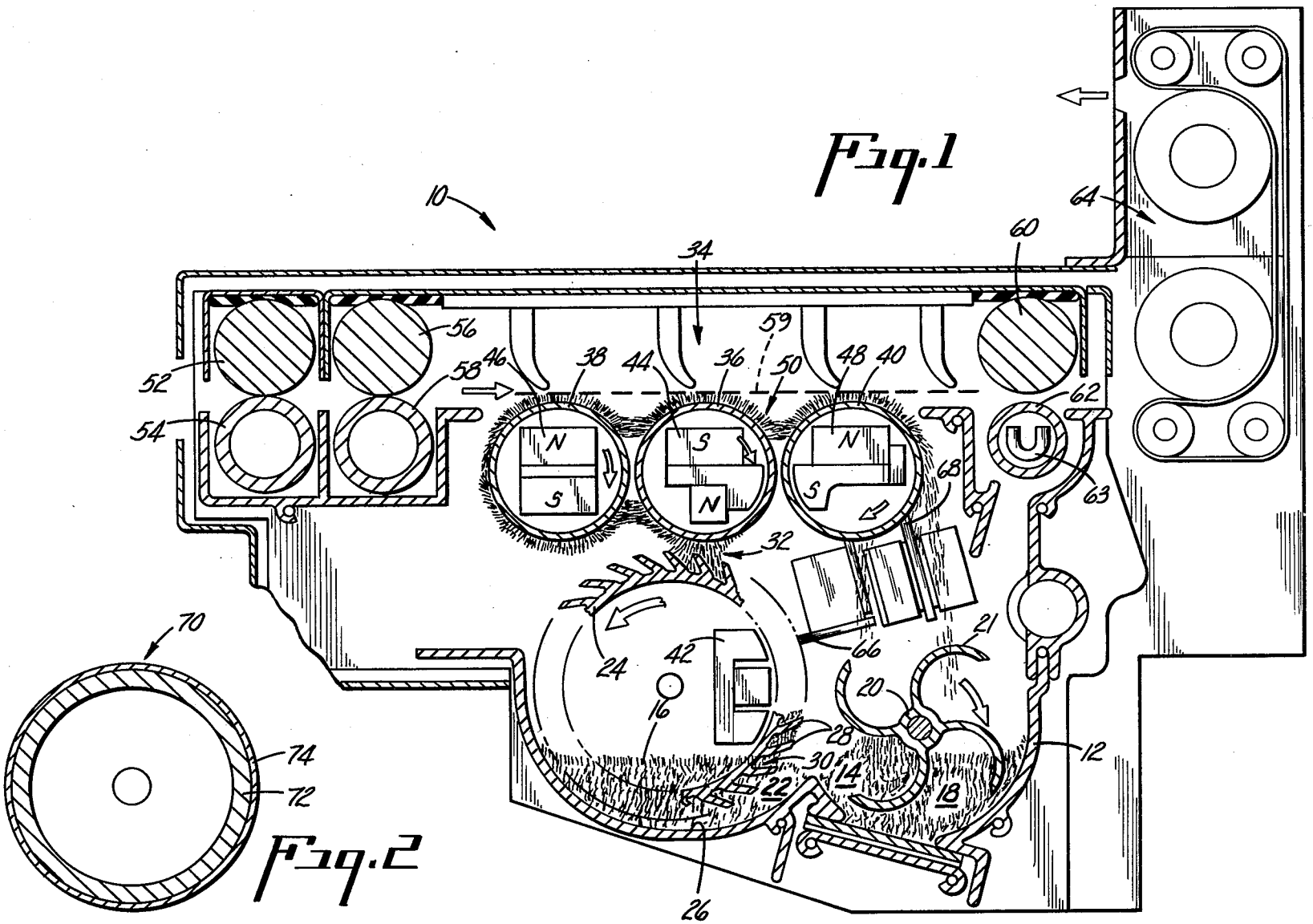
FIG. 1 is a cross-section of a magnetic brush developer construction showing one embodiment of the developer feeder.
FIG. 2 is a cross-section of another embodiment of a metering drum of this invention.

Referring now to FIG. 1 of the drawing, there is shown a developer assembly bearing the general character reference 10 which is formed of an outside casing or housing 12 which encloses the various operating elements that give rise to a self-metering magnetic brush developer. At the bottom of the housing there is formed a reservoir 14 into which is deposited a supply of the pulverulent developer mix 16 from which metered amounts of powder are withdrawn. The reservoir 14 is formed into two principal sections, the first being the mixing section 18 which contains a mixing device 20 equipped with perforated blades 21 which extend the full lateral width of the reservoir so as to urge and move the developer mix in the direction of the other part of the reservoir which is the feeder section 22.

That portion of the casing which forms the feeder section 22 of the reservoir 14 is generally of an arcuate configuration in order to accommodate the metering drum 24 which is housed in this section of the reservoir. The drum 24 is generally fittingly mounted into the feeder section of the reservoir having a diameter which approximates the contour radius of the feeder section 22 but leaving a sufficient space between the inside wall 26 of the feeder section and the outer reaches of the drum 24, so as to provide enough clearance for any excess material to flow between the drum and the inside surface and return to the mixing section 18. In practice, the drum 24 has a diameter of 3.5 inches.

The outside surface of the drum 24 is of fluted construction 28 which extends the longitudinal dimension of the drum with each fluted portion 30 having a predetermined size dimension so that it picks up and carries a predetermined mass of developer 16.

In tracing the movement of the developer mix within the reservoir, it should be observed that as the mixer 20 rotates in a clockwise direction, the curved tines 21 pick up a quantity of the material and move it in the direction of the counterclockwise rotating drum 24. The quantity of the developer mix picked up as it passes through the supply reservoir is retained within the flute with the aid of a magnetic flux generating means 42 as the drum moves in a counterclockwise direction and brought up to the depositing station 32. Because the linear velocity of the drum is such that it may tend to throw out powder from the flutes by centrifugal force, the magnet 42 is employed to retain the mass within the flutes.

The series of three hollow drum constructions 36, 38 and 40 are aligned within the housing 12 at a position above the metering drum 24 to form the developing station 34. The drum 24 is partially immersed in the supply of powder 16 so that as each of the flutes 30 pass through the supply of developer mix 16, a quantity is trapped within and carried to a transfer station where the developer mix is removed from each of the flutes and deposited on one of the surfaces of a train of developer cylinders 36, 38 and 40 from whence it becomes a stream of developer particles that are conveyed by magnetic flux means to the developing station. The axes of rotation of each of the cylinders 36, 38 and 40 are axially parallel to one another and generally lie on the same horizontal plane and are also in parallel alignment with the axis of rotation of the drum 24.

Within each of the hollow cylinders 36, 38 and 40 there is disposed magnetic flux generating means 44, 46 and 48 respectively. In each case the flux generating means comprises a series of bar magnets arranged and selected so that the strength and pattern of the flux field is designed to attract the developer mix from the flutes and to transmit the developer mix in a stream path which ultimately forms a magnetic brush at the developer station 34.

The following chart shows the effective gauss values for controlling a typical developer mix as it moves through the system:

| Flux Generator | Cylinder Position | Gauss Units |
|---|---|---|
| 42 | 3 o'clock | 210–240 |
| 44 | 6 o'clock | 400–700 |
| 44 | 12 o'clock | 600–700 |
| 46 | 6 o'clock | 500–600 |
| 46 | 12 o'clock | 500–600 |
| 46 | 9 o'clock | 200–250 |
| 48 | 12 o'clock | 450–500 |
| 48 | 4:30 o'clock | 50–55 |

As shown in FIG. 1, the flux generating means 44 is of sufficient strength to attract and remove the developer mix from within the flute 30 at the depositing station 32 so that it clings to the outside surface of the cylinder 36 as it rotates through the station 32. The developer mix is attracted to and held onto the surface of the cylinder 36 at the 6 o'clock position. As the cylinder 36 rotates in a clockwise direction, the mass of developer particles are brought within the flux field generated by the flux generator 46. The developer mass is transferred from the six o'clock position of the cylinder 36 to the 6 o'clock position of the cylinder 38 and is conveyed around and to the top of the cylinder 38. Continued rotation of the cylinder 38 causes the developer mix to be transferred to the 12 o'clock position of the cylinder 36 where it is captured by the flux field emanating from the flux generator 44. The presence of the cylinder 40 and its flux generating means 48 causes the stream of developer mix to bridge the rollers 36 and 40 so that the moving stream across the top surface of each of the cylinders 36, 38 and 40 presents a continuous moving carpet 50 of developer mix, upstanding at the respective 12 o'clock positions.

The stream of developer mix is carried from the surface of the cylinder 40 by the flux generating means 48 to a point where it is thereafter directed along a return path into the reservoir. The flux generating means is so arranged so that the flux pattern can attract the developer mix to its surface for a limited distance and thereafter the toner is freed from the influence of such flux where it returns to the reservoir 14 by force of gravity.

At the upper portion of the housing 12 are positioned a series of pinched roller sets 52, 54 and 56, 58 and exit rollers 60, 62. The first two sets of pinched rollers 52, 54 and 56, 58 form an infeed station which directs the copy sheet into the assembly along the path represented by the dashed line 59 and in position to make rubbing contact with the continuous carpet 50 of developer mix and thence between the roller set 60, 62 and into the exit conveyor system 64. Surprisingly, the carpet 50 in the general area of the 12 0'clock position at each of the hollow cylinders forms into an upstanding brush of the proper height, bristle formation and density of bristles so as to optimize development of the copy sheet as it moves along the path 59. This optimum brush formation virtually completely engages the full extent of the copy paper as it moves along the path 59. This is achieved without the aid of any blades, scrapers, doctoring devices and the like in the stream path of the developer mix.

The roller set 60 and 62 are not pinched rollers. They are maintained in spaced apart relation. The back side of the developed copy sheet is urged against roller 60 while the powder image-carrying surface confronts, but does not touch, the roller 62. With the roller 62 is a conventional horseshoe magnet with its pole pieces facing in the direction of the powder carrying surface of the copy sheet. This particular construction of the roller 62 renders it useful to scavenge any spurious magnetic carrier particles that may have been attracted to the copy. Such a scavenging technique is important, particularly in the circumstance where the powder is to be fixed by pressure techniques.

Associated with the drum 24 is scraping member 66 which assists in the removal of any developer mix which overflows the confining walls of the flutes 30. In this manner a measured amount of developer mix is contained in the flutes and delivered to the depositing station 32. Similarly, a blade 68 is associated with the surface of the cylinder 40 at the point where the flux pattern is no longer effective in removing any developer powder that may be clinging to the surface of the drum 40 and also guiding the material that falls free from the surface along the return path into the reservoir 14. It should be pointed out that neither scraper 66 or blade 68 introduce any significant stress to the toner which causes it to compact or agglomerate.

In tracing the flow of the developer mix in the developer assembly 10, it will be seen that the supply material in the reservoir 14 moves from the feed section 18 into the path of the fluted construction 28 on the surface of the drum 24 and is delivered to the depositing station 32 where it is picked up by the central cylinder 36 at the six o'clock position and transferred to the six o'clock position of the next adjacent cylinder 38 and then carried around to the top of the cylinder 38 where the developer mix bridges the three rolls 36, 38 and 40 to form the continuous carpet 50. It will be appreciated that at no point in the path of movement of the developer mix is it exposed to high compression forces. It will be remembered that the toner material, which is an important ingredient in the developer mix, is of a thermoplastic character and is very susceptible to compaction losing its granularity. Further, under highly compressive forces it tends to accumulate and cling to the various surfaces on which it is carried. It is important to appreciate that the avoidance of any high degree of compaction is achieved by feeding measured and controlled amounts of developer mass to the developer brush. Under the influence of a certain flux generating means there will be formed a developing carpet of particular size and dimensions and which will be maintained as long as measured amounts are fed to the train of cylinders.

Referring to FIG. 2, there is shown another embodiment whereby measured amounts of developer mix are delivered to the depositing station 32. As shown in FIG. 2 there is provided a metering drum 70 formed of a cylindrical shell 72. The metering drum 70 is of the same overall diameter as the drum 24 and adapted to operate within the feeder section 22 of the reservoir 14. Disposed about the outer surface of the drum 72 is permanently affixed a flux generating magnetic blanket member 74 adapted to produce a magnetic flux field of a specific strength in order to attract a predetermined mass of developer mix to its surface. Such suitable magnetic blanket members are available from the 3M Company and sold under the trade name PLASTIFORM, Catalog Nos. MGO-1016 and MGO-1012. These materials are completely flexible sheets impregnated with magnetic flux generating means. In the fabrication of the metering drum 70 itself, non-magnetic materials are used such as brass and aluminum extruded to the appropriate diameter of 3.44 inches and having a wall thickness in the range of from 0.12 inches to 0.25 inches. The flexible member 74 is applied to the surface so it forms a continous sheath enveloping the outside surface of the drum and is applied by conventional adhesive materials. The thickness of the magnetic blanket can range from 0.030 inches or 0.060 inches, the preferred thickness being 0.060 inches. It will be appreciated that the construction of FIG. 2 may be directly substituted for the metering drum 24 shown in FIG. 1 providing the full and equal advantages realized from the fluted type surface metering drum.

The foregoing description of the invention has been presented in somewhat detailed form to fully illustrate a unique and novel way of handling the very sensitive developer mix. It is intended that the advantages of handling such developer mix by means of a metered system to be defined by the appended claims.

What is claimed is:

1. In a magnetic brush developing device adapted to have a controlled height of brush formation including a source supply of pulverulent developer mix made up of magnetically attractable carrier particles and toner particles, comprising:

a rotatably mounted metering drum partially immersed in said source supply, said metering drum having formed on its outer surface means for attracting and holding thereon a predetermined capacity for carrying measured quantities of said developer mix;

magnetic brush developer means comprising a plurality of rotatably mounted tubular structures in parallel axial alignment with one another forming a lower reach and upper reach respectively along the underside and upper surface of said tubular structures, and said tubular structures having magnetic flux generating means disposed therein so as to form a flux field along said lower and upper reaches of said tubular structures establishing a fixed stream path for said developer mix having a starting point and a termination point, said metering drum being positioned adjacent said lower reach defining the starting point of said stream path and said magnetic flux means within said tubular structures effective to move the developer mix along said lower reach from said starting point and along said upper reach and to form a terminating point for said stream path at the end of said upper reach so as to bring said measured quantities of developer mix within the flux field thereby establishing a developer brush of a predetermined height, said developer mix being returned to the source supply at said terminating point.

2. The magnetic brush developing device as claimed in claimm 1 wherein said drum means for carrying measured quantities of developer mix comprises receptacles having a predetermined carrying capacity.

3. The magnetic brush developing device as claimed in claim 1 wherein said means for carrying measured quantities of developer mix comprises a surface capable of generating a predetermined level of magnetic flux so as to attract a predetermined quantity of developer mix.

4. The magnetic brush developing device as claimed in claim 2 wherein said receptacles consist of a series of fluted formations on the surface extending the axial length of the tubular structure.

5. The magnetic brush developing device as claimed in claim 1 wherein said magnetic brush developing means comprises three tubular structures and the stream path for said developer mix originates at the lower reach of the middle one of the three tubular structures.

6. The magnetic brush developing device as claimed in claim 1 wherein said metering drum and said tubular structures are made of non-magnetic materials of construction.

7. In a magnetic brush developing device adapted to have a conrolled height of brush formation including a source supply of pulverulent developer mix made up of magnetically attractable carrier particles and toner particles and feed means for feeding a copy paper to be developed, comprising:

a rotatably mounted metering drum partially immersed in said source supply, said metering drum having formed on its outer surface a series of fluted formations extending the axial length of the drum for carrying measured quantities of said developer mix therein and having disposed within said drum magnetic flux generating means for releasably retaining said developer mix within said formations;

magnetic brush developer means comprising an array of at least three rotatably mounted tubular structures in parallel axial alignment with one another forming a lower reach and upper reach respectively along the underside and upper surface of said tubular structures and said tubular structures having magnetic flux generating means disposed therein so as to form a flux field extending along said lower and upper reaches of said rotating tubular structures establishing a fixed stream path for said developer mix having a starting point and a termination point, said fixed stream path originating at the lower reach of the center one of the tubular structures and advancing to the upper reach spanning the three structures in a direction cocurrent with the movement of said copy paper and said termination point occurring at the location where said copy paper departs from said stream path.

* * * * *

UNITED STATES PATENT AND TRADEMARK OFFICE

CERTIFICATE OF CORRECTION

PATENT NO. : 4,022,157

DATED : 5/10/77

INVENTOR(S) : Houshang Rasekhi and Philip Shemkunas

It is certified that error appears in the above-identified patent and that said Letters Patent are hereby corrected as shown below:

Column 6, line 38, delete "advantages of" and substitute therefor --apparatus for--; line 40, delete "to"; claim 3, line 2, after "said" insert --drum--; claim 4, line 4, delete "tubular structure" and substitute --metering drum--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*